US010820730B2

(12) United States Patent
Garza Muguerza

(10) Patent No.: US 10,820,730 B2
(45) Date of Patent: Nov. 3, 2020

(54) ICE RESTRAINER APPARATUS

(71) Applicant: Joaquin Garza Muguerza, San Antonio, TX (US)

(72) Inventor: Joaquin Garza Muguerza, San Antonio, TX (US)

( * ) Notice: Subject to any disclaimer, the term of this patent is extended or adjusted under 35 U.S.C. 154(b) by 70 days.

(21) Appl. No.: 16/278,167

(22) Filed: Feb. 17, 2019

(65) Prior Publication Data

US 2020/0260890 A1 Aug. 20, 2020

(51) Int. Cl.
*A47G 19/22* (2006.01)

(52) U.S. Cl.
CPC ..... *A47G 19/2211* (2013.01)

(58) Field of Classification Search
CPC ... A47G 19/2211; A47G 19/005; A47J 31/06; A47J 31/14; A47J 43/24; A47J 36/08; C02F 2307/04; C02F 1/003
(Continued)

(56) References Cited

U.S. PATENT DOCUMENTS 1,569,445 A * 1/1926 Workman ..... A47J 31/14 222/144.5
1,717,170 A * 6/1929 Pelletier ..... A47G 19/12 210/469

(Continued)

FOREIGN PATENT DOCUMENTS

DE 4231279 A1 * 3/1994 ..... A47G 19/2211
DE 9406599 U1 * 6/1994 ..... A47G 19/2211
GB 191313492 A * 4/1914 ..... A47G 19/2211

*Primary Examiner* — Allan D Stevens
(74) *Attorney, Agent, or Firm* — McLean Law LLC; Kimberly McLean, Esq.

(57) ABSTRACT

An ice restrainer apparatus including a primary ring member and a secondary ring member. The primary ring member has a fixed diameter and a circular web-like structure including an outer peripheral edge and a plurality of restraining elements within the circular web-like structure. The primary ring member fits inside a beverage container. The primary ring member including a pair of horizontally positioned guiding rails located along the center of a top surface of the primary ring member for receiving the secondary ring member. The secondary ring member having an adjustable diameter and collectively formed by a first semicircle region and a second semicircle region which are interconnected by a diameter adjustment assembly. The secondary ring member having an outer peripheral edge and including an inner circular member and an outer circular web-like member. The inner circular member having the diameter adjustment assembly positioned horizontally along the center of the inner circular member. The diameter adjustment assembly including a pair of adjusting handles which are attached to corresponding adjusting handle base members, which are positioned at opposite ends of the inner circular member and including a spring mechanism positioned between the pair of adjusting handles and adjusting handle base members, the outer circular web-like member having a plurality of restraining elements thereon, and wherein the diameter of the secondary ring member is adjustable such that the outer peripheral edge of the secondary ring member exceeds the outer peripheral edge of the primary ring member to allow the ice restrainer apparatus to fit in beverage containers having a larger diameter than the primary ring member.

9 Claims, 2 Drawing Sheets

(58) Field of Classification Search
USPC ..... 220/703, 704; 210/464, 469, 474, 476; 222/189.07, 189.08
See application file for complete search history.

(56) References Cited

U.S. PATENT DOCUMENTS

| | | | | | |
|---|---|---|---|---|---|
| 1,759,588 | A * | 5/1930 | Pelletier | A47G 19/12 | 210/469 |
| 2,398,978 | A * | 4/1946 | Udell | A47J 36/08 | 210/469 |
| 2,744,631 | A * | 5/1956 | Toombs | A47G 19/2211 | 210/469 |
| 3,269,545 | A * | 8/1966 | Udell | A47J 36/08 | 210/469 |
| 2003/0006185 | A1* | 1/2003 | Hepler | A47J 31/06 | 210/464 |
| 2003/0015537 | A1* | 1/2003 | Konja | B60K 15/077 | 220/563 |
| 2011/0101008 | A1* | 5/2011 | Draganic, III | A47G 19/2272 | 220/703 |
| 2012/0223089 | A1* | 9/2012 | Moore | A47G 19/2288 | 220/703 |
| 2016/0073806 | A1* | 3/2016 | Heaton | A23L 2/72 | 426/495 |

* cited by examiner

ICE RESTRAINER APPARATUS

FIELD OF THE INVENTION

Embodiments described herein generally relate to an ice restrainer, and more particularly to an ice restrainer having an adjustable size.

BACKGROUND OF THE INVENTION

Typically, beverages in restaurants are served in glasses full of ice. This can be bothersome to consumers who prefer their beverages ice-free or with minimal ice. Moreover, ice can potentially cause an obstruction in the passage of the beverage or a consumer may potentially choke on the ice. Hence, it is desirable to restrain ice in beverages from entering the mouth, permitting at all times a free and unobstructed pass through of beverages, without the interruption of the ice.

BRIEF DESCRIPTION OF THE DRAWINGS

The various advantages of the embodiments of the present disclosure will become apparent to one skilled in the art by reading the following specification and appended claims, and by referencing the following drawings, in which:

SUMMARY OF THE INVENTION

Figure 1:
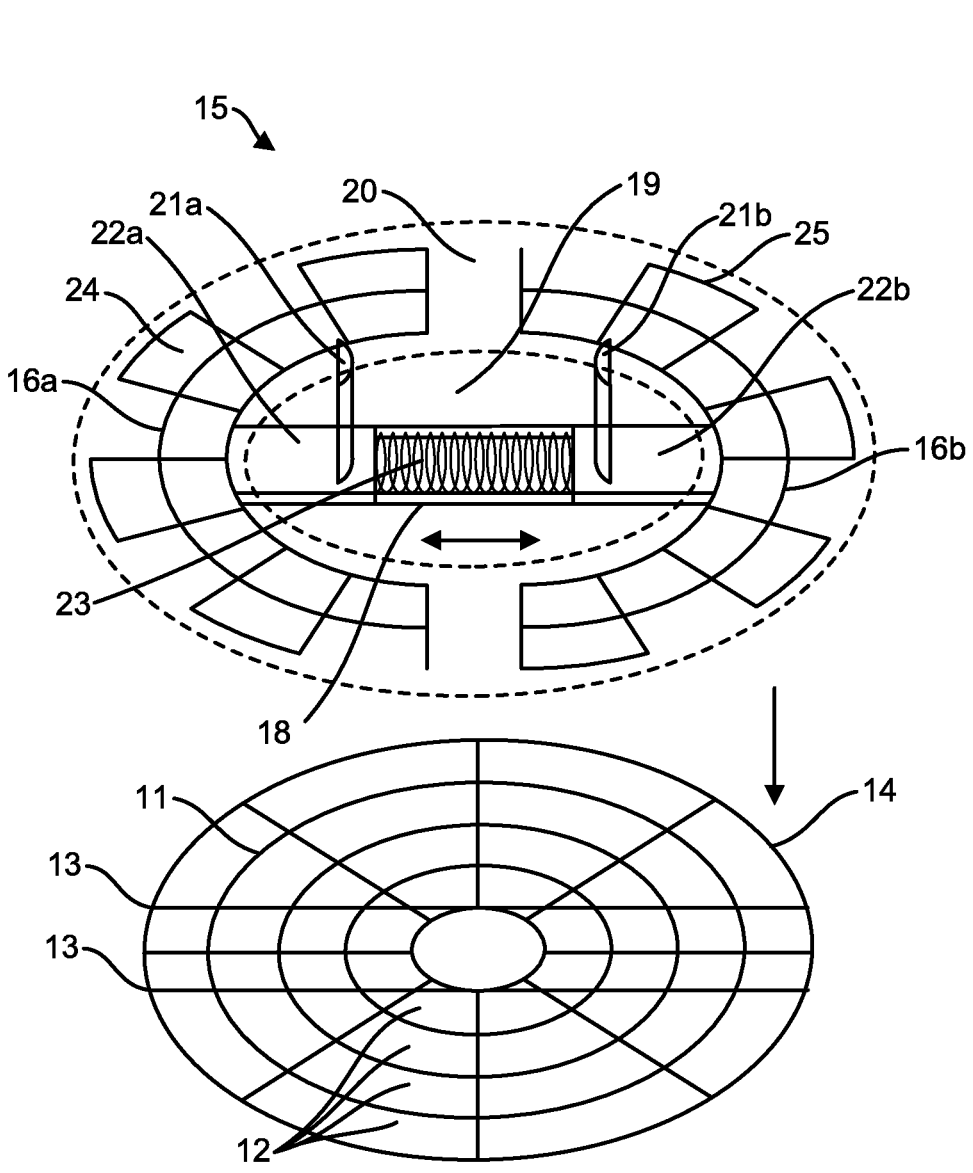
FIG. 1 shows an exemplary exploded view of an ice restrainer apparatus according to an embodiment of the present disclosure.

Exemplary embodiments disclosed herein describe an ice restrainer apparatus including a primary ring member and a secondary ring member. The primary ring member has a fixed diameter and a circular web-like structure including an outer peripheral edge and a plurality of restraining elements within the circular web-like structure. The primary ring member fits inside a beverage container. The primary ring member including a pair of horizontally positioned guiding rails located along the center of a top surface of the primary ring member for receiving the secondary ring member. The secondary ring member having an adjustable diameter and collectively formed by a first semicircle region and a second semicircle region which are interconnected by a diameter adjustment assembly. The secondary ring member having an outer peripheral edge and including an inner circular member and an outer circular web-like member. The inner circular member having the diameter adjustment assembly positioned horizontally along the center of the inner circular member. The diameter adjustment assembly including a pair of adjusting handles which are attached to corresponding adjusting handle base members, which are positioned at opposite ends of the inner circular member and including a spring mechanism positioned between the pair of adjusting handles and adjusting handle base members, the outer circular web-like member having a plurality of restraining elements thereon, and wherein the diameter of the secondary ring member is adjustable such that the outer peripheral edge of the secondary ring member exceeds the outer peripheral edge of the primary ring member to allow the ice restrainer apparatus to fit in beverage containers having a larger diameter than the primary ring member.

In some exemplary embodiments, the secondary ring member is removably attached to the primary ring member.

In some exemplary embodiments, the diameter adjustment system connects to the pair of guiding rails on the primary ring member.

In some exemplary embodiments, the diameter of the secondary ring member is adjustable to increase or decrease.

In some exemplary embodiments, the diameter of the secondary ring member is adjustable to increase by pulling apart the pair of adjusting handles along the guiding rails thereby stretching the spring mechanism.

In some exemplary embodiments, the diameter of the secondary ring member is adjustable to decrease by pushing the pair of adjusting handles along the guiding rails towards one another thereby compressing the spring mechanism.

In some exemplary embodiments, the plurality of restraining elements in the primary ring member are apertures having varying sizes ranging from a largest aperture positioned adjacent to the outer most peripheral edge of the primary ring member and a smallest aperture positioned adjacent to the inner most peripheral edge of the primary ring member.

In some exemplary embodiments, the plurality of restraining elements in the outer circular web-like member are apertures.

In some exemplary embodiments, the plurality of restraining elements prevent the passage of ice.

In some exemplary embodiments, the plurality of restraining elements prevent the passage of one or more tea bags.

DETAILED DESCRIPTION

Figure 2:
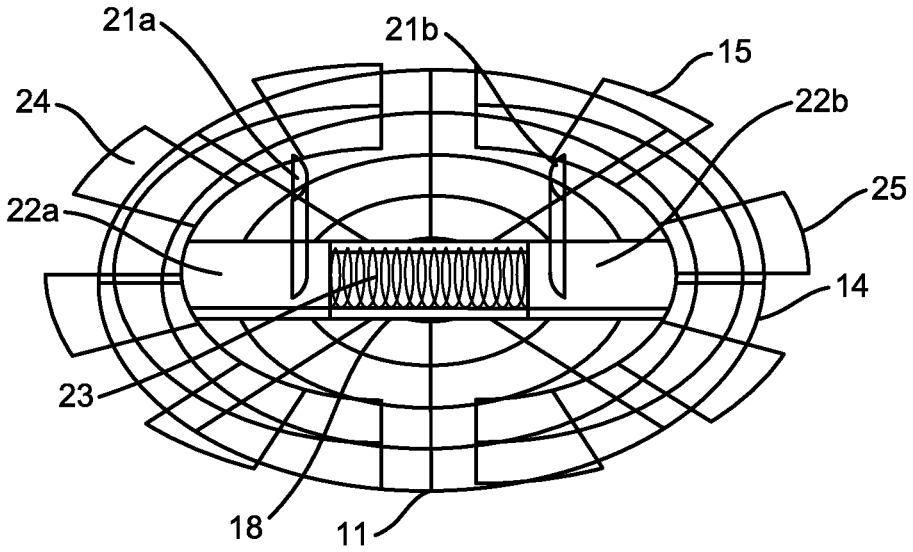
FIG. 2 shows an exemplary view of an ice restrainer apparatus according to an embodiment of the present disclosure.

The present disclosure relates to an ice restrainer apparatus 10 having an adjustable diameter to fit any size beverage container. As illustrated in FIGS. 1-2, the apparatus 10 includes a primary ring member 11 and a secondary ring member 15 and has a circular web-like structure which is placed inside a beverage container to block ice. The primary ring member 11 has a fixed diameter and the secondary ring member 15 has an adjustable diameter. The primary ring may be used by itself if its diameter is sufficient to fit inside a beverage container. If the primary ring member is too small, the secondary ring member is configured to attach to the top surface of the primary ring member to expand the diameter of the apparatus.

As illustrated in FIG. 2, the outer peripheral edge 25 of the secondary ring member 15 extends out from the outer peripheral edge 14 of the primary ring member 11 in a normal stance when the secondary ring member is attached to the primary ring member without any adjustments to the secondary ring member. If that diameter is not sufficient, the diameter of the secondary ring member may be increased as needed to a diameter sufficient to fit a beverage container such that the outer peripheral edge of the secondary ring member extends further out from the outer peripheral edge of the primary ring member. Once increased, the secondary ring member may be decreased in diameter or removed from the primary ring member to adjust the diameter of the apparatus 10 as needed to fit in a beverage container.

The primary ring member 11 has a circular fixed diameter web-like structure which is configured to fit inside a beverage container. The primary ring member includes an outer peripheral edge 14, a plurality of restraining elements 12 and a pair of guiding rails 13. The plurality of restraining elements 12 are positioned within the circular web-like structure and are apertures of varying sizes ranging from a largest aperture positioned adjacent to the outer most peripheral edge (i.e., the outer peripheral edge 14) of the primary ring member to a smallest aperture positioned adjacent to the inner most peripheral edge of the primary ring member. The plurality of restraining elements block the passage of ice through the primary ring member. Moreover, the plurality of restraining elements may block the passage of any other object(s) in the drink, such as, for example, tea bags, through the primary ring member.

The pair of guiding rails 13 are positioned horizontally along the center of the top surface of the primary ring member 11. The guiding rails are embedded on the top surface of the primary ring member. The pair of guiding rails are configured to receive the diameter adjustment assembly 18. The guiding rails are a same distance apart as the width of the diameter adjustment assembly 18 and have a same length as the length of the diameter adjustment assembly.

The secondary ring member 15 has a circular structure with an adjustable diameter. The secondary ring member is collectively formed by a first semicircle region 16*a*, a second semicircle region 16*b*, and a diameter adjustment assembly 18. The first semicircle region 16*a* and the second semicircle region 16*b* collectively form an inner circular member 19 and an outer circular member 20. The inner circular member 19 has disposed therein the diameter adjustment assembly 18, which is positioned horizontally along the center of the inner circular member.

The diameter adjustment assembly 18 includes a pair of adjusting handles 21*a* and 21*b* which are attached to corresponding adjusting handle base members 22*a* and 22*b*. The pairs of adjusting handles and corresponding adjusting handle base members are positioned at opposite ends of the inner circular member 19. The diameter adjustment assembly includes a spring mechanism 23 interposed between the pairs of adjusting handles and corresponding adjusting handle base members. The spring mechanism 23 is configured to exert enough force to the secondary ring to maintain the ice restrainer apparatus 10 fixed inside the drinking container.

The diameter adjustment assembly 18 is configured to connect to the pair of guiding rails 13 on the top surface of the primary ring member 11. The secondary ring member 15 is attachably connected to the primary ring member by way of the connection between the diameter adjustment assembly and the pair of guiding rails. The secondary ring member may be removed from the primary ring member by extracting the diameter adjustment assembly from the pair of guiding rails 13.

The diameter adjustment assembly 18 operates to increase the diameter of the apparatus 10 when needed to accommodate a beverage container having a diameter size larger than the diameter size of the primary ring member 11. The diameter of the apparatus 10 is increased by increasing the diameter of the secondary ring member 15, which is accomplished by pulling the adjusting handles 21*a* and 21*b* and their corresponding adjusting handle base members 22*a* and 22*b* along the guiding rails 13 in a direction away from another, thereby stretching the spring mechanism 23.

Conversely, the diameter adjustment assembly 18 operates to decrease the diameter of the apparatus 10 when needed to accommodate a beverage container. The diameter of the apparatus 10 is decreased by decreasing the diameter of the secondary ring member 15, which is accomplished by pushing the adjusting handles 21*a* and 21*b* and their corresponding adjusting handle base members 22*a* and 22*b* along the guiding rails 13 in a direction towards one another, thereby compressing the spring mechanism 23. Alternatively, the diameter of the apparatus may be decreased by removing the secondary ring member 15 from the primary ring member 11.

The outer circular member 20 has a circular web-like structure and includes a plurality of restraining elements 24. The restraining elements are apertures which prevent the passage of objects in the drink, such as, for example, ice, tea bags, etc.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.)

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Those skilled in the art will appreciate from the foregoing description that the broad techniques of the embodiments of the present invention may be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. An ice restrainer apparatus comprising:

a primary ring member having a fixed diameter circular web-like structure including an outer peripheral edge and a plurality of restraining elements within the circular web-like structure, wherein the primary ring member is configured to fit inside a beverage container, the primary ring member including a pair of horizontally positioned guiding rails located along a center of a top surface of the primary ring member for receiving a secondary ring member;

the secondary ring member having an adjustable diameter and collectively formed by a first semicircle region and a second semicircle region which are interconnected by a diameter adjustment assembly, the secondary ring member having an outer peripheral edge and including an inner circular member and an outer circular web-like member, the inner circular member having the diameter adjustment assembly positioned horizontally along a center of the inner circular member, the diameter adjustment assembly including a pair of adjusting handles which are attached to corresponding adjusting handle base members, which are positioned at opposite ends of the inner circular member and including a spring mechanism positioned between the pair of adjusting handles and also positioned between the adjusting handle base members, the outer circular web-like member having a plurality of restraining elements therein, and wherein the diameter of the secondary ring member is adjustable such that the outer peripheral edge of the secondary ring member exceeds the outer peripheral edge of the primary ring member to allow the ice restrainer apparatus to fit in beverage containers having a larger diameter than the primary ring member.

2. The apparatus of claim 1, wherein the secondary ring member is removably attached to the primary ring member.

3. The apparatus of claim 1, wherein the diameter adjustment system connects to the pair of guiding rails on the primary ring member.

4. The apparatus of claim 1, wherein the diameter of the secondary ring member is adjustable to increase by pulling apart the pair of adjusting handles along the guiding rails thereby stretching the spring mechanism.

5. The apparatus of claim 1, wherein the diameter of the secondary ring member is adjustable to decrease by pushing the pair of adjusting handles along the guiding rails towards one another thereby compressing the spring mechanism.

6. The apparatus of claim 1, wherein the plurality of restraining elements in the primary ring member are apertures having varying sizes ranging from a largest aperture positioned adjacent to the outer peripheral edge of the primary ring member and a smallest aperture positioned adjacent to an inner most peripheral edge of the primary ring member.

7. The apparatus of claim 1, wherein the plurality of restraining elements in the outer circular web-like member are apertures.

8. The apparatus of claim 1, wherein the fixed diameter circular web-like structure and the outer circular web-like member are configured to prevent the passage of ice.

9. The apparatus of claim 1, wherein the fixed diameter circular web-like structure and the outer circular web-like member are configured to prevent the passage of one or more tea bags.

* * * * *